US010219073B1

(12) United States Patent
Walus et al.

(10) Patent No.: US 10,219,073 B1
(45) Date of Patent: Feb. 26, 2019

(54) VEHICLE AUDIO SYSTEM

(71) Applicant: Ford Global Technologies, LLC, Dearborn, MI (US)

(72) Inventors: David M. Walus, Fenton, MI (US); Ronald Eric Zlotnik, Belleville, MI (US); Ryan Anderson, Milford, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 15/818,664

(22) Filed: Nov. 20, 2017

(51) Int. Cl.
*H04R 3/00* (2006.01)

(52) U.S. Cl.
CPC ..... *H04R 3/007* (2013.01); *H04R 2420/03* (2013.01); *H04R 2499/13* (2013.01)

(58) Field of Classification Search
CPC ..... H04R 2499/13; H04R 3/007
See application file for complete search history.

(56) References Cited

U.S. PATENT DOCUMENTS 5,453,716 A 9/1995 Person et al.
7,154,954 B1 * 12/2006 Nagatani ..... H04L 25/0292 375/257
8,515,617 B2 8/2013 Wille et al.
9,417,944 B2 8/2016 Kessler
9,448,959 B2 9/2016 Hooper et al.
9,841,940 B2 * 12/2017 Khazin ..... G06F 1/08
2009/0197551 A1 * 8/2009 Paraskake ..... H04B 1/086 455/179.1
2010/0026360 A1 * 2/2010 Ogura ..... H03K 19/00346 327/309
2013/0290577 A1 * 10/2013 Fugate ..... G06F 13/4081 710/105
2014/0241370 A1 * 8/2014 Itou ..... H04L 45/44 370/396
2015/0365754 A1 12/2015 Perl
2016/0034416 A1 * 2/2016 Chavez ..... H04B 3/542 381/59
2016/0088390 A1 3/2016 Han
2017/0201370 A1 * 7/2017 Sengoku ..... H04L 7/0045

OTHER PUBLICATIONS

Analog Devices Automotive Audio Bus (A2B), Analog Devices, Inc, Sep. 30, 2015.
In-Car Audio Development Platform Applies ADI'S A2B Technology, Graham Prophet, Dec. 22, 2015.

* cited by examiner

*Primary Examiner* — Mohammad Islam
(74) *Attorney, Agent, or Firm* — Frank A. MacKenzie; Bejin Bieneman PLC

(57) ABSTRACT

A two-wire communication system includes a first audio circuit, and a second audio circuit electrically connected to the first audio circuit via a two-wire bi-directional multi-node communication bus. The communication connects the first audio circuit to the second audio circuit wherein an audio signal, an enable signal, and a clip detect signal are transmitted over the bus.

15 Claims, 8 Drawing Sheets

VEHICLE AUDIO SYSTEM

BACKGROUND

Vehicle audio circuits such as radio, media player, amplifier, etc. are typically interconnected via wiring to transfer audio signal and/or control signals. The vehicles typically include separate wires interconnecting the audio circuits to one another.

DETAILED DESCRIPTION

Figure 1:
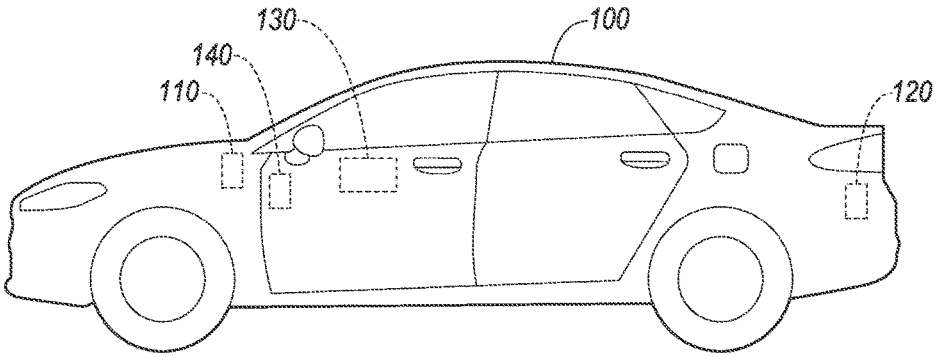
FIG. 1 shows an example vehicle including an example audio system.

Vehicle audio systems, e.g., a radio, media player, etc., typically include one or more audio circuits that generate an audio signal and one or more amplifiers that output the audio signal, e.g., via a speaker. An amplifier typically cannot output an audio signal with an amplitude greater than a maximum limit, e.g., a function of its power supply voltage. When the maximum limit of the amplifier is reached, increasing gain may distort (or clip) the outputted audio signal. A speaker coupled to an amplifier output may have a maximum acceptable audio signal amplitude and/or power. An increase of the audio signal amplitude output to the speaker with an amplitude beyond the maximum acceptable audio signal amplitude of the speaker may damage the speaker. Therefore, the amplifier may output a clip detect signal to the audio signal producing circuit, such as the radio, to indicate that the amplitude of the audio signal has reached the maximum limit associated with the amplifier and/or the speaker. Additionally or alternatively, the audio circuit, e.g., the radio, may output an enable signal to the amplifier to activate the amplifier. The clip detect signal(s) and/or the enable signal(s) may be transmitted between the audio circuits via electrical wiring connecting the audio circuits. Typically, the clip detect signal(s) and/or the enable signal(s) are transmitted via dedicated wiring, meaning a wire transmitting only a specific signal, e.g., the clip detect signal from an amplifier to a radio. The audio system of a vehicle may be designed to reduce cost of wiring of the audio circuits of the vehicle. An example of a cost-effective audio system is designed to transmit the clip detect signal(s) and the enable signal(s) via same wires that transmit the audio signals between vehicle audio circuits, e.g., from a radio to an amplifier.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

Disclosed herein is a two-wire communication system including a first audio circuit, and a second audio circuit electrically connected to the first audio circuit via a two-wire bi-directional multi-node communication bus, wherein the two-wire bi-directional multi-node communication bus connects the first audio circuit to the second audio circuit wherein an audio signal, an enable signal, and a clip detect signal are transmitted over the bus.

The two-wire communication system may further include a first two-wire communication circuit having an audio enable input, a clip detect output, and a first two-wire communication chip electrically connected to the bus, wherein the audio enable input and the clip detect output are electrically coupled to the first audio circuit, and a second two-wire communication circuit having an audio enable output, a clip detect input, and a second two-wire communication chip electrically connected to the first two-wire communication chip via the bus, wherein the audio enable output and the clip detect input are electrically coupled to the second audio circuit.

The first audio circuit may include the first two-wire communication circuit in communication with a first processor and the second audio circuit may include the second two-wire communication circuit in communication with a second processor.

The second audio circuit may further include the second processor and a second memory, the second memory storing instructions executable by the second processor to detect the clip based on an amplitude of received audio signal.

The audio enable output may be electrically connected to the second processor.

The first audio circuit may further include the first processor and a first memory. The first memory may store instructions executable by the first processor to generate the enable signal based on a received activation request from a human machine interface.

The audio enable input and the clip detect output may be electrically connected to the first processor.

The first memory may store further instructions executable by the first processor to adjust, based on the clip detect signal, an amplitude of the audio signal transmitted by the first audio circuit.

The two-wire communication system may further include a first signal converter circuit that electrically couples the first two-wire communication circuit and the first audio circuit, wherein the first signal converter circuit is configured to generate the enable signal on the audio enable input based on an analog voltage sensed at a tri-state input output of the first signal converter circuit.

The first signal converter circuit may be configured to adjust the analog voltage of the tri-state input output based on the clip detect signal.

The two-wire communication system may further include a second signal converter circuit that electrically couples the second two-wire communication circuit and the second audio circuit wherein the second signal converter circuit is configured to generate the clip detect signal based on an analog voltage sensed at a tri-state input output of the second signal converter circuit.

The first two-wire communication circuit may be configured to transmit the audio signal and the enable signal, and to receive the clip detect signal via the bus.

An amplitude of the audio signal may be adjustable based on the clip detect signal.

The second audio circuit may be activated based on the enable signal.

The two-wire communication system may further include a third audio circuit, wherein the first, second, and third audio circuits are daisy chained via two-wire bi-directional multi-node communication buses.

The first audio circuit may include a radio and the second audio circuit includes an audio amplifier circuit.

FIG. 1 illustrates an example vehicle 100. The vehicle 100 may be powered by, e.g., an electric motor and/or internal combustion engine. The vehicle 100 may be a land vehicle such as a car, truck, etc. The vehicle 100 may include a computer 110, a sound system 120, sensor(s) 130, and a human machine interface (HMI) 140.

The computer 110 includes a processor and a memory. The memory includes one or more forms of computer-readable media, and stores instructions executable by the computer 110 for performing various operations, including as disclosed herein.

The computer 110 is programmed to operate one or more of vehicle brakes, propulsion (e.g., control of acceleration in the vehicle by controlling one or more of an internal combustion engine, electric motor, hybrid engine, etc.), steering, climate control, the sound system 120, etc., The computer 110 may include or be communicatively coupled to various devices included in the vehicle 100 for monitoring and/or controlling various vehicle controllers, e.g., a powertrain controller, a brake controller, a steering controller, etc. The computer 110 may be connected to a vehicle communication network that can include a bus in the vehicle 100 such as a controller area network (CAN) or the like, and/or other wired and/or wireless mechanisms.

Via the vehicle 100 network, the computer 110 transmits messages to various devices in the vehicle and/or receives messages from the various devices, e.g., the HMI 140, etc. Alternatively or additionally, in cases where the computer 110 includes multiple devices, the vehicle 100 communication network may be used for communications between devices represented as the computer 110. As discussed further below, various electronic controllers and/or sensors 130 may provide data to the computer 110 via the vehicle communication network.

The sensors 130 of the vehicle 100 may include a variety of devices known to provide data via the vehicle communications bus. For example, the sensors 130 may include one or more microphones, camera, radar, infrared, and/or LIDAR sensors 130 disposed in the vehicle 100 and/or on the vehicle 100 providing data encompassing at least some of the vehicle 100 exterior.

The HMI 140 may be programmed to receive user input, e.g., during operation of the vehicle 100. For example, a user may select a radio station for the audio system 120, e.g., by providing an input via the HMI 140. Moreover, the HMI 140 may be programmed to present information to the user. As another example, a user may select a volume (loudness) of audio signal output of the sound system 120 via the HMI 140. The HMI 140 may be implemented via electronic components, touchscreens, buttons, knobs, etc.

The sound system 120 may include a variety of devices to provide an audio signal via speakers included in the vehicle 100. The sound system 120 may include devices such as a radio, media player, etc., that capture and/or generate audio signal, and devices such as amplifier(s) and/or speakers that receive the generated audio signal and output the audio signal in the form of sound waves.

Figure 2A:
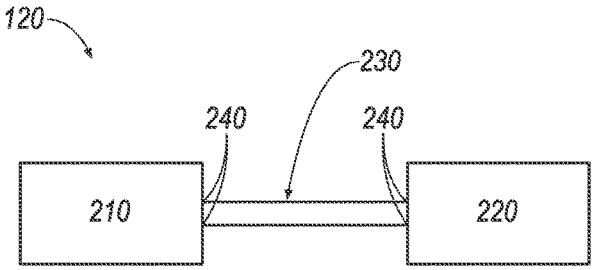
FIG. 2A shows an example audio system having two electrically connected audio circuits.

FIG. 2A shows an example implementation of the sound system 120 that includes a first audio circuit 210 and a second audio circuit 220 electrically connected to the first audio circuit 210 via a two-wire bi-directional multi-node communication bus 230. The communication bus 230 (or sometimes referred to as communication link) connects, e.g., the first audio circuit 210 to the second audio circuit 220. An audio signal, an enable signal, and a clip detect signal are transmitted over the bus 230.

The devices such as a radio, media player, etc., that capture and/or generate audio signals (e.g., with a radio) are referred to as the first audio circuit(s) 210, and the devices such as a speaker and/or audio amplifier circuit that receive audio signals are referred to as the second audio circuits 220. An amplifier may receive the audio signal, amplify an amplitude of the received audio signal, and output the amplified audio signal to, e.g., a speaker. Additionally or alternatively a device may include a combination of the first and second audio circuits 210, 220.

The communication bus 230, in the context of present disclosure, may be implemented by wires, connectors, chips, electronic circuits, etc. "Bi-directional" means data such as the audio signal, the enable signal, and the clip detect signal can be transmitted in both directions through the communication bus 230. For example, the audio signal and the enable signal may be transmitted from the first audio circuit 210 to the second audio circuit 220, whereas the clip detect signal may be transmitted from the second audio circuit 220 to the first audio circuit 210. The bus 230 may include a two-wire medium such as a twisted pair wire. The bus 230 may electrically connect terminals 240 of the first and second audio circuits 210, 220.

Figure 2B:
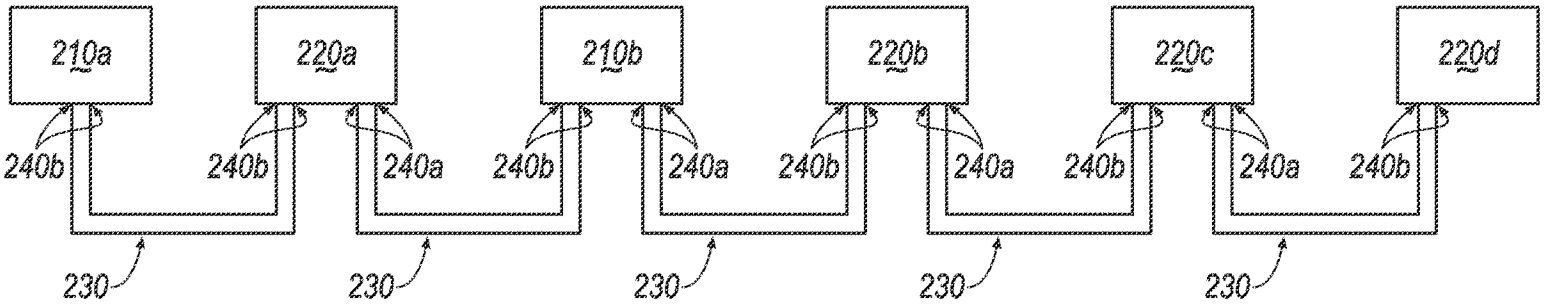
FIG. 2B shows another example audio system having multiple daisy-chained audio circuits.

"Multi-node", in the present context, means multiple first and second audio circuits 210, 220 are included in the sound system 120 and communicatively connected. FIG. 2B shows a multi-node communication bus 230 providing communication between multiple first and second audio circuits 210, 220. The communication bus 230 may allow a point-to-point (i.e., between first and second audio circuits 210, 220) connection and may allow multiple first and second audio circuits 210, 220 at different locations, e.g., a front, rear, etc., of an interior of the vehicle 100 to communicate.

The sound system 120 may include multiple audio circuits, each with a first audio circuit 210 and a second audio circuit 220. Thus, the sound system 120 may include multiple audio circuits, e.g., one or more of first audio circuits 210 and one or more of second audio circuits 220, that are daisy chained via a two-wire bi-directional multi-node communication bus 230. "Daisy-chained" means the first and second audio circuits 210, 220 are wired (through the bus 230) together in a sequence. For example, as shown in FIG. 2B, the sound system 120 may include one or more first audio circuits 210, and one or more of second audio circuits 220, e.g., two of first audio circuits 210*a*, 210*b* such as a radio and a media player, and four of second audio circuits 220*a*, 220*b*, 220*c*, 220*d* such as four amplifiers with speaker in four corners of an interior of the vehicle 100, as shown in FIG. 2B. The communication bus 230 in a daisy-chain scheme may provide communication to multiple audio circuits 210, 220 such that the first and second audio circuits 210*a*, 220*b* are connected via the first bus 230, the second audio circuits 220*a*, 220*b* connected via the second bus 230, etc. and the second audio circuit 220*d* and the first audio circuits 210*a* are connected to establish the daisy-chain. In one example, each of the first and second audio circuits 210, 220 may include two terminals 240*a*, 240*b* and the first and second audio circuits 210, 220 may be daisy-chained by connecting the terminals 240*a*, 240*b* to two other first and/or second audio circuits 210, 220.

Figure 3:
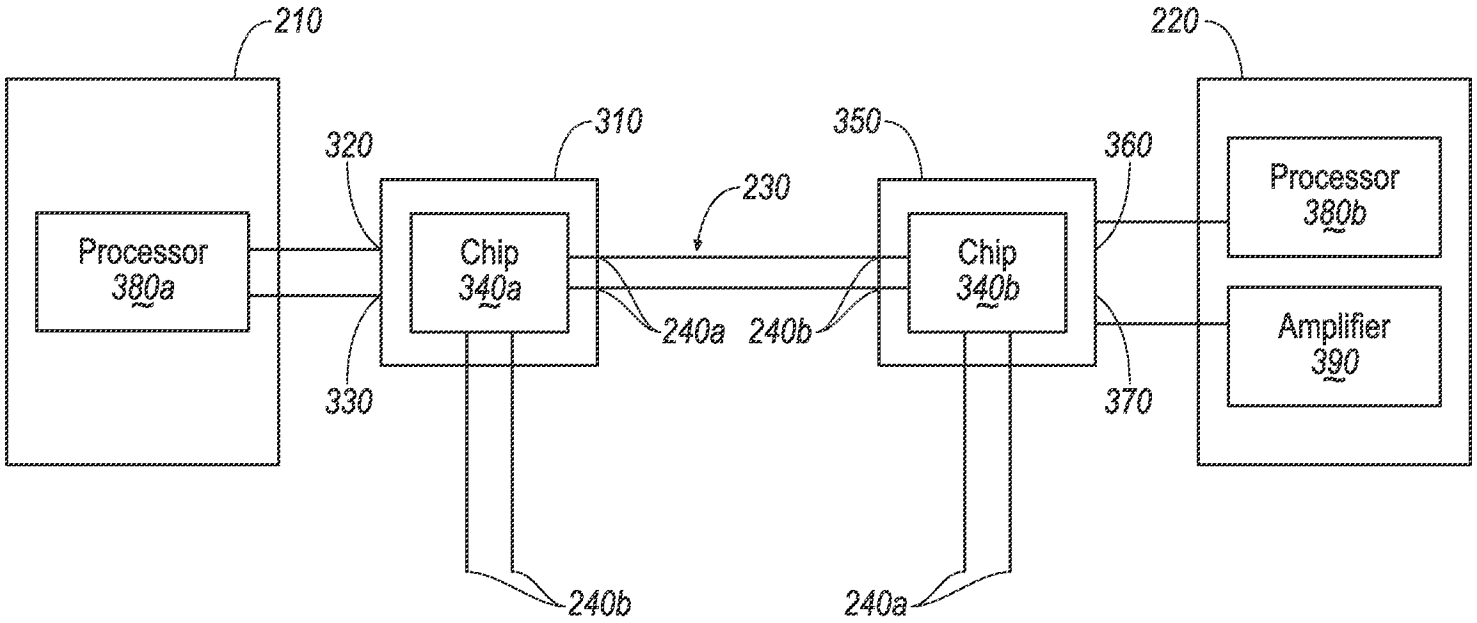
FIG. 3 shows an example communication bus between two audio circuits.

FIG. 3 illustrates an example sound system 120 with two first and second audio circuits 210, 220 connected via a two two-wire communication circuits 310 and the bus 230. The first two-wire communication circuit 310 may include an audio enable input 320, a clip detect output 330, and a first two-wire communication chip 340*a* electrically connected to the bus 230. The audio enable input 320 and the clip detect output 330 may be electrically coupled to the first audio circuit 210. The second two-wire communication circuit 350 may include an audio enable output 360, a clip detect input 370, and a second two-wire communication chip 340*b* electrically connected to the first two-wire communication chip 340*a* via the bus 230. The audio enable output 360 and the clip detect input 370 may be electrically coupled to the second audio circuit 220. The first and second chips 340*a*, 340*b* may be electrically connected to the first and/or second audio circuits 210, 220.

The first and second chips 340*a*, 340*b* may transmit and receive data including the audio signal, the audio enable, and the clip detect signal via the two-wire bus 230. In one example, the first and second chips 340*a*, 340*b* may operate based on an Automotive Audio Bus (A2B) protocol. Thus, the first and second chips 340*a*, 340*b* may transmit and receive data using a time division multiplex technique. In the time division multiplex technique, each time slot may be associated with a predetermine content and/or a predetermined first and/or second audio circuit 210, 220. The two-wire bus 230 can be used to communicate various type of information including audio signal, enable signal, clip detect signal, etc. The first and/or second chips 340*a*, 340*b* may be programmed to transmit and/or receive various type of data through the bus 230. In one example, the computer 110 may be programmed to instruct the first and/or second chips 340*a*, 340*b* to provide communication between the first and/or second audio circuits 210, 220. The computer 110 may be programmed to instruct the first chip 340 to transmit audio signal and enable signal. The computer 110 may be programmed to instruct the second chip 340 to receive audio signal and transmit the clip detect signal. Additionally or alternatively, the computer 110 may be programmed to instruct the chips 340, e.g., based on an input received via the HMI 140. For example, the computer 110 may receive an input requesting an activation of the first audio circuit 210, e.g., radio, to output sound via the second audio circuit 220, e.g., front speakers in the interior of the vehicle 100. Based on the received input, the computer 110 may be programmed to instruct the first chip 340 to transmit audio signals of the radio (i.e., the first audio circuit 210) and the enable signal, and to receive the clip detect signal. The computer 110 may be programmed to instruct the second chip 340 to receive the audio signal and the enable signal and to transmit the clip detect signal.

In one example, the first and second two-wire communication circuits 310, 350 may be included in the first and/or second audio circuits 210, 220. For example, electrical connectors of the first and/or second audio circuits 210, 220 may include the terminals 240*a*, 240*b* which can be electrically connected via the buses 230, e.g., to form a daisy chain. In another example, the two-wire communication circuits 310, 350 may be disposed outside the first and/or second audio circuits 210, 220, e.g., inside a wiring harness connector housing that provides a mechanical and electrical connection between the bus 230 and the first and/or second audio circuits 210, 220.

The first audio circuit 210 may include a first processor 380*a* that is in communication with the first two-wire communication circuit 310. For example, the first processor 380*a* of the first audio circuit 210 may be electrically connected to the audio enable input 320 and the clip detect output 330 of the first two-wire communication circuit 310. The first processor 380*a* may be programmed to generate the enable signal based on, e.g., a received activation request from an HMI 140.

The first processor 380*a* may be programmed to adjust an amplitude of the audio signal output from the first audio circuit 210 based on the clip detect signal. For example, the first processor 380*a* may be programmed to reduce the amplitude of the audio signal upon activation of the clip detect signal. In one example, the first processor 380*a* may be programmed to reduce the amplitude of the audio signal by a predetermined amount, e.g., on the order of 5%, and determine after elapsing a predetermined time, e.g., on the order of 200 milliseconds (ms), whether a status of the clip detect signal changes to inactive; otherwise incrementally reducing the amplitude of the audio signal, etc.

The second audio circuit 350 may include an amplifier 390. The amplifier 390 may include electrical components and/or integrated circuits such as one or more operational amplifier (OpAmp) circuits. The amplifier 390 may receive the audio signal from the first audio circuit 210, amplify an amplitude of the received audio signal, and output the amplified audio signal to, e.g., a speaker included in the second audio circuit 220 and/or electrically connected to the second audio circuit 220. The amplifier 390 may include a clip detection circuit that is programmed to generate the clip detect signal as a result of the amplitude of the received audio signal exceeding a predetermined threshold, e.g., 90% of a supply voltage of the amplifier 390. Additionally or alternatively, the second audio circuit 220 may include a second processor 380*b* that is programmed to detect the clip based on an amplitude of received audio signal. The clip detect signal may be transmitted via the clip detect input 370 of the second audio circuit 350 and the bus 230 to, e.g., the first audio circuit 210. The second processor 380*b* of the second audio circuit 220 may be electrically connected to the audio enable output 360. The second processor 380*b* may be programmed to receive the enable signal via the audio enable output 360. A status of the received enable signal may be one of active or inactive. The second processor 380*b* may be programmed to activate the amplifier 390 to output the audio signal, e.g., via the speaker, as a result of an activation of the enable signal. Additionally or alternatively, the audio enable output 360 may be connected to, e.g., an enable input of, the amplifier 390. The amplifier 390 may be configured to operate and/or turn off based on the status of the received enable signal at the amplifier 390 enable input.

As discussed above, the communication among the first and/or second audio circuits 210, 220 may be a multi-node communication. In one example, the vehicle 100 computer 110 may be programmed to instruct the chips 340*a*, 340*b* of the two-wire communication circuits 310, 350 to operate according to, e.g., a user input received via the HMI 140 of the vehicle 100. Thus, the computer 110 can be programmed to command a chip 340 of a two-wire communication circuit 310, 350 to be a "sender" and/or a "receiver". Commanding the chip 340 to be a sender, in the present context, means that the respective chip 340 transmits the audio signal and the enable signal, and receives the clip detect signal. Commanding the chip 340 to be a receiver, in the present context, means that the respective chip 340 receives the audio signal and the enable signal, and transmits the clip detect signal. The computer 110 may be programmed to determine which of the first and/or second audio circuits 210, 220 should operate as sender and/or receiver based on input received via the HMI 140. Additionally, the computer 110 may be programmed to command a chip 340 of a two-wire communication circuit 310, 350 to be "turned off," i.e., neither operating as a sender nor a receiver.

Figure 4:
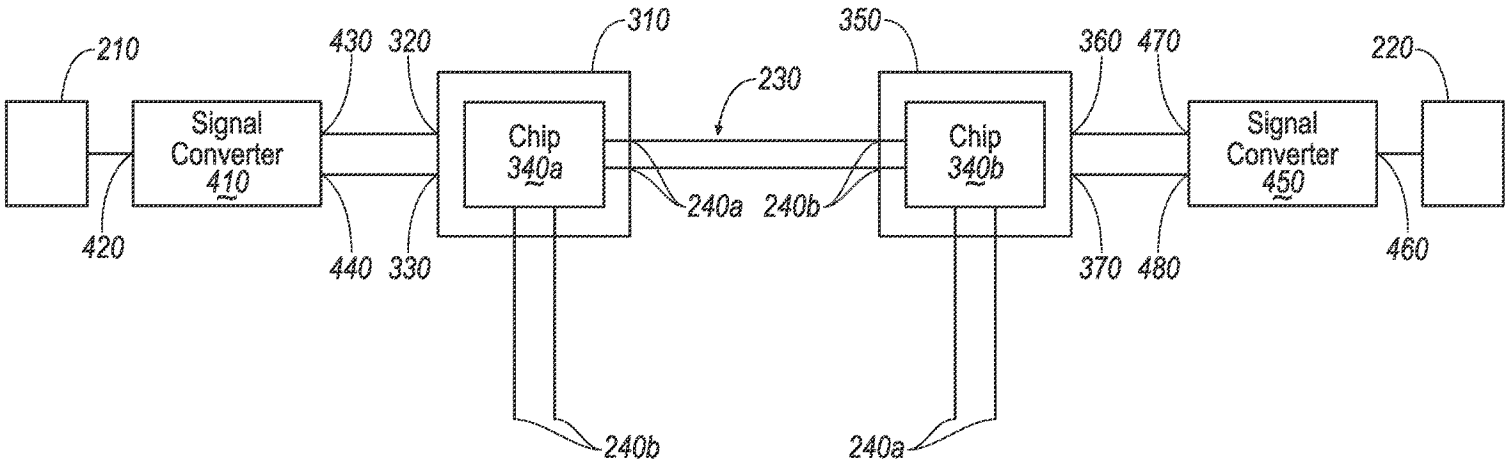
FIG. 4 shows another example communication bus including first and second signal converter circuits.

FIG. 4 illustrates another example sound system 120 with two first and second audio circuits 210, 220 connected via two two-wire communication circuits 310, 350 and signal converters 410, 450. In this example, which may occur if the first and/or second audio circuits 210, 220 lack an ability to transmit and/or receive the enable signal and/or the clip detect signal as distinct digital signals, the first audio circuit 210 may transmit and receive the enable signal and the clip detect signal via a tri-state analog signal. "Tri-state analog signal" (sometimes referred to as simply a "tri-state signal" below) in the context of present disclosure, means the analog signal has three possible status: audio disable (e.g., 0 Volt), audio enable (e.g., 5 Volt), and clip detected (e.g., 8 Volt). Thus, for example, an 8 Volt signal value of the tri-state signal means a clip has been detected. In such example, as discussed below, the tri-state signal of the audio circuits 210, 220 may be converted to the audio enables and the clip detect signals using a converter, as discussed below.

Figure 5:
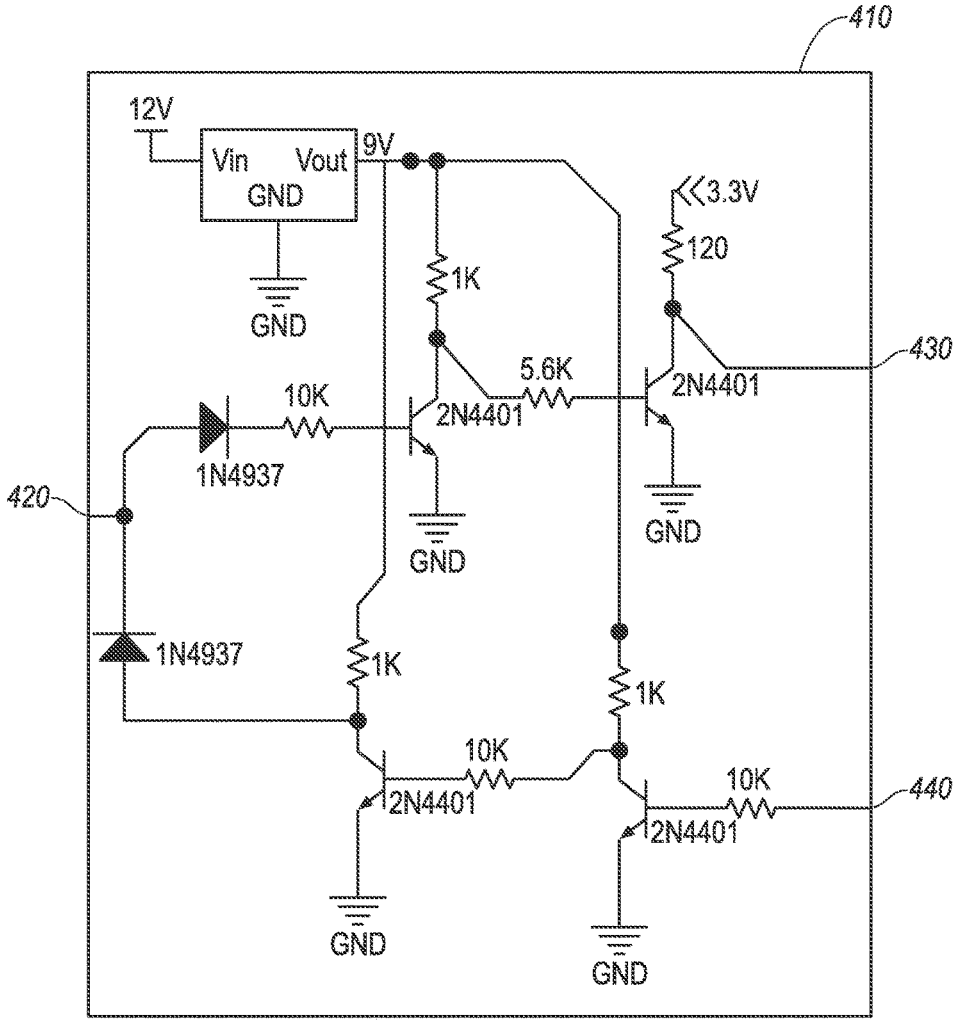
FIG. 5 shows an example first signal converter circuit.

The sound system 120 may include a first signal converter circuit 410 that electrically connects the first two-wire communication circuit 310 and the first audio circuit 210. The first signal converter circuit 410 may be configured to generate the enable signal on the audio enable input 320 based on an analog voltage sensed at a tri-state input output 420 of the first signal converter circuit 410. The first signal converter 410 may be configured to activate the enable signal at a terminal 430 upon sensing, e.g., 5 Volt signal at the tri-state input output 420. The first signal converter circuit 410 may be configured to adjust the analog voltage of the tri-state input output 420 based on the clip detect signal received via a terminal 440. For example, the first signal converter circuit 410 may be configured to increase the analog voltage of the tri-state input output 420 as a result of an activation of the clip detect signal at the terminal 440. FIG. 5 shows an example implementation of the first signal converter 410 that includes electrical components such as transistors, resistors, diodes, etc.

Figure 6:
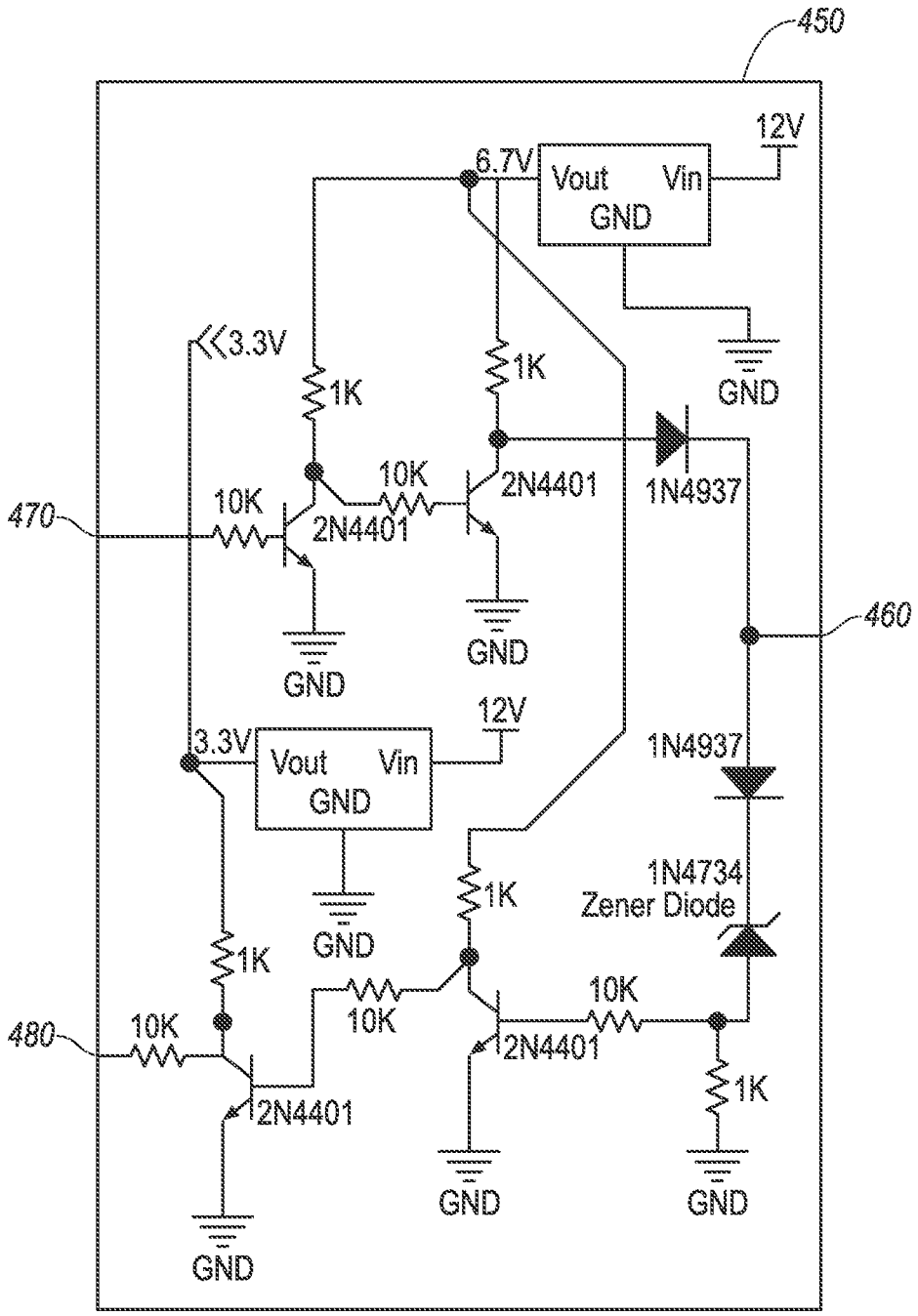
FIG. 6 shows an example second signal converter circuit.

The sound system 120 may include a second signal converter circuit 450 that electrically connects the second two-wire communication circuit 350 and the second audio circuit 220. The second signal converter circuit 450 may be configured to receive the enable signal on a terminal 470 and generate the clip detect signal on a terminal 480. The second signal converter 450 may be electrically coupled to second audio circuit 220 via a tri-state input output 460, and may be electrically coupled to the audio enable output 360 and clip detect input 370 of the second two-wire communication circuit 350 via the terminals 470, 480. The second signal converter circuit 450 may be configured to generate the clip detect signal based on an analog voltage sensed at a tri-state input output 460 of the second signal converter circuit 450. The terminal 480 may be electrically connected to the clip detect input 370. The second signal converter 450 may be configured to activate the clip detect signal upon sensing a voltage at the tri-state input output 460 that exceeds a threshold, e.g., 8 Volt. The second signal converter 450 may be configured to output 0 (zero) or 5 Volts via the tri-state input output 460 upon determining that the enable signal received via the terminal 470, that is connected to the audio enable out 360, is inactive or active respectively. FIG. 6 shows an example implementation of the second signal converter 450 that includes electrical components such as transistors, resistors, diodes, etc.

Processing

Figure 7:
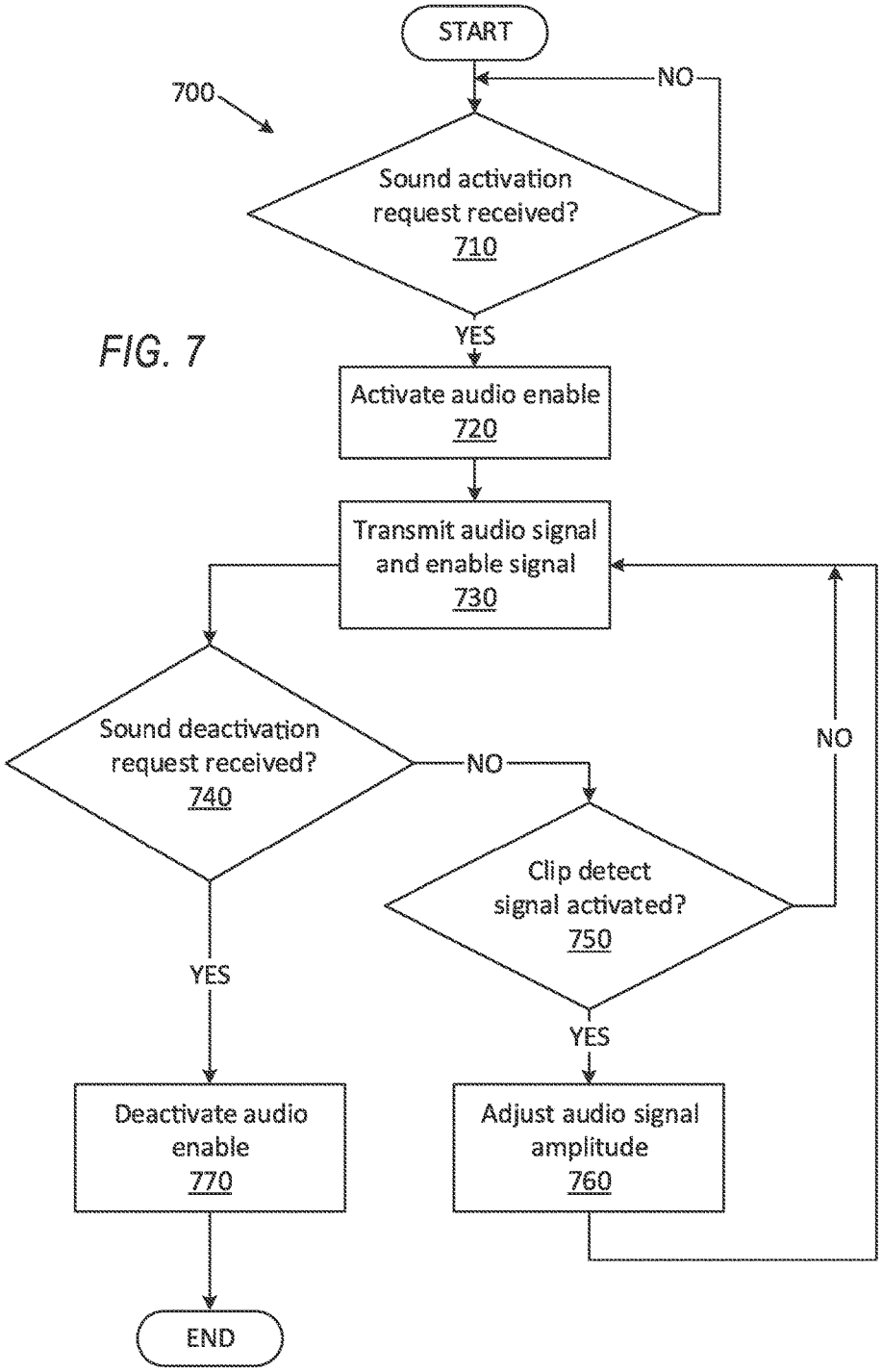
FIG. 7 is a flowchart of an example process for transmitting audio signal.

FIG. 7 is a flowchart of an example process 700 for transmitting audio signals. A processor 380*a* of a first audio circuit 210 may be programmed to execute blocks of the process 700.

The process 700 begins in a decision block 710, in which the processor 380*a* determines whether a sound activation request was received. For example, the processor 380*a* may be programmed to receive a user input via the HMI 140 of the vehicle 100. The use input may include a request for activation of, e.g., a second audio circuit 220 to output radio sound generated by the first audio circuit 210 via a speaker of the second audio circuit 220. If the processor 380*a* determines that the sound activation request was received, then the process 700 proceeds to a block 720; otherwise the process 700 returns to the decision block 710.

In the block 720, the processor 380*a* activates an enable signal. The processor 380*a* may be programmed to activate an output pin of the processor 380*a* which is electrically connected to the audio enable input 320.

Following the block 720, a decision block 750, or a block 760, in a block 730, the processor 380*a* actuates the first chip 340*a* to transmit the audio signal and the enable signal. For example, the processor 380*a* may be programmed to actuate the first chip 340*a* to transmit, via the two-wire bi-directional bus 230, the audio signal and the enable signal to the second audio circuit 220 (See FIG. 3). As another example, the processor 380*a* may be programmed to transmit the audio signal and the enable signal via a daisy-chain to the second audio circuit 220*d* (see FIG. 2B).

Next, in a decision block 740, the processor 380*a* determines whether a sound deactivation request was received. The processor 380*a* may be programmed to determine whether a user input including a request to, e.g., turn off the sound, was received via the HMI 140. If the processor 380*a* determines that the sound deactivation request was received, then the process 700 proceeds to a block 770; otherwise the process 700 proceeds to the decision block 750.

In the decision block 750, the processor 380*a* receives the clip detect signal and determines the received clip detect signal has an active status. The processor 380*a* may be programmed to receive the clip detect signal from the clip detect output 330 via an input pin of the processor 380*a*. If the processor 380*a* determines that the status of the clip detect signal is active, then the process 700 proceeds to a block 760; otherwise the process 700 returns to the block 730.

In the block 760, the processor 380*a* adjusts the amplitude of the audio signal. For example, the processor 380*a* may be programmed to reduce the amplitude of the audio signal by a predetermined amount, e.g., on the order of 5%. Following the block 760, the process 700 returns to the block 730.

In the block 770, the processor 380*a* deactivates the audio enable signal, e.g., by turning off the output of the processor 380*a* that is electrically connected the audio enable input 320. Following the block 770, the process 700 ends, or alternatively returns to the decision block 710, although not shown in FIG. 7.

Figure 8:
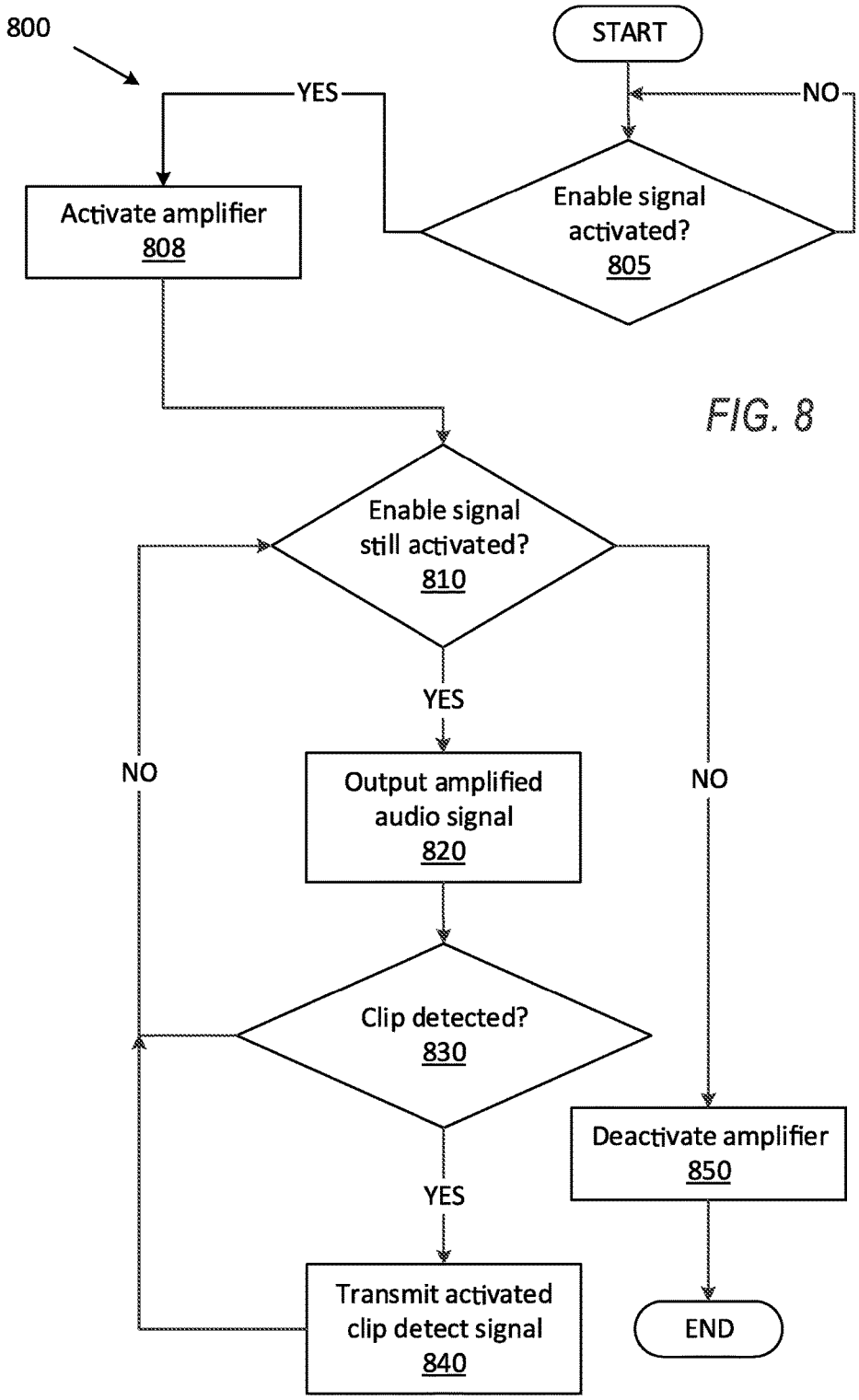
FIG. 8 is a flowchart of an example process for receiving audio signal.

FIG. 8 is a flowchart of an example process 800 for receiving audio signals. A processor 380*b* of a second audio circuit 220 may be programmed to execute blocks of the process 800.

The process 800 begins in a block 805, in which the processor 380*b* determines whether the enable signal is activated. The processor 380*b* may be programmed to receive the enable signal from the audio enable output 360 via an input pin of the processor 380*b*. The processor 380*b* may be programmed to determine the status of the enable signal. If the processor 380*b* determines that the enable signal is active, then the process 800 proceeds to a block 808; otherwise the process 800 proceeds to a block 805.

In the block 808, the processor 380*b* activates the amplifier 390. The processor 380*b* may be programmed to turn on a power supply of the amplifier 390.

Next, in a decision block 810, the processor 380*b* determines whether the enable signal is still activated. The processor 380*b* may be programmed to receive the enable signal from the audio enable output 360 via an input pin of the processor 380*b*. The processor 380*b* may be programmed to determine the status of the enable signal. If the processor 380*b* determines that the enable signal is still active, then the process 800 proceeds to a block 820; otherwise the process 800 proceeds to a block 850.

In the block 820, the processor 380*b* activates the amplifier 390 to amplify the received audio signal and output the amplified audio signal, e.g., via one or more speakers of the second audio circuit 220.

Next, in a decision block 830, the processor 380*b* determines whether a clip of the amplified audio signal is detected. The processor 380*b* may be programmed to determine the clip upon determining that the amplitude of the amplified audio signal exceeds a maximum limit of the amplifier and/or the speaker. If the processor 380*b* detects the clip, then the process 800 proceeds to a block 840; otherwise the process 800 returns to the decision block 810.

In the block 840, the processor 380*b* transmits the activated clip detect signal, e.g., to a first audio circuit 210. The processor 380*b* may be programmed to command the second chip 340*b* to transmit the clip detect signal via the two-wire bi-directional bus 230 to one or more first audio circuits 210. Following the block 840, the process 800 returns to the decision block 810.

In the block 850, the processor 380*b* deactivates the amplifier 390. The processor 380*b* may be programmed to turn off a power supply of the amplifier 390.

Following the block 850, the process 800 ends, or alternatively returns to the decision block 710, although not shown in FIG. 8.

The article "a" modifying a noun should be understood as meaning one or more unless stated otherwise, or context requires otherwise. The phrase "based on" encompasses being partly or entirely based on.

Computing devices as discussed herein generally each include instructions executable by one or more computing devices such as those identified above, and for carrying out blocks or steps of processes described above. Computer-executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media. A file in the computing device is generally a collection of data stored on a computer readable medium, such as a storage medium, a random access memory, etc.

A computer-readable medium includes any medium that participates in providing data (e.g., instructions), which may be read by a computer. Such a medium may take many forms, including, but not limited to, non-volatile media, volatile media, etc. Non-volatile media include, for example, optical or magnetic disks and other persistent memory. Volatile media include dynamic random access memory (DRAM), which typically constitutes a main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH, an EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

What is claimed is:

1. A two-wire communication system comprising:

a first audio circuit;

a second audio circuit electrically connected to the first audio circuit via a two-wire bi-directional multi-node communication bus, wherein the two-wire bi-directional multi-node communication bus connects the first audio circuit to the second audio circuit wherein an audio signal, an enable signal, and a clip detect signal are transmitted over the bus;

a first two-wire communication circuit having an audio enable input, a clip detect output, and a first two-wire communication chip electrically connected to the bus, wherein the audio enable input and the clip detect output are electrically coupled to the first audio circuit; and a second two-wire communication circuit having an audio enable output, a clip detect input, and a second two-wire communication chip electrically connected to the first two-wire communication chip via the bus, wherein the audio enable output and the clip detect input are electrically coupled to the second audio circuit.

2. The two-wire communication system of claim 1, wherein the first audio circuit includes the first two-wire communication circuit in communication with a first processor and the second audio circuit includes the second two-wire communication circuit in communication with a second processor.

3. The two-wire communication system of claim 2, wherein the second audio circuit further comprises the second processor and a second memory, the second memory storing instructions executable by the second processor to detect the clip based on an amplitude of received audio signal.

4. The two-wire communication system of claim 3, wherein the audio enable output is electrically connected to the second processor.

5. The two-wire communication system of claim 2, wherein the first audio circuit further comprises the first processor and a first memory, the first memory storing instructions executable by the first processor to generate the enable signal based on a received activation request from a human machine interface.

6. The two-wire communication system of claim 5, wherein the audio enable input and the clip detect output are electrically connected to the first processor.

7. The two-wire communication system of claim 5, wherein the first memory stores further instructions executable by the first processor to adjust, based on the clip detect signal, an amplitude of the audio signal transmitted by the first audio circuit.

8. The two-wire communication system of claim 1, further comprising a first signal converter circuit that electrically couples the first two-wire communication circuit and the first audio circuit, wherein the first signal converter circuit is configured to generate the enable signal on the audio enable input based on an analog voltage sensed at a tri-state input output of the first signal converter circuit.

9. The two-wire communication system of claim 8, wherein the first signal converter circuit is configured to adjust the analog voltage of the tri-state input output based on the clip detect signal.

10. The two-wire communication system of claim 1, further comprising a second signal converter circuit that electrically couples the second two-wire communication circuit and the second audio circuit wherein the second signal converter circuit is configured to generate the clip detect signal based on an analog voltage sensed at a tri-state input output of the second signal converter circuit.

11. The two-wire communication system of claim 1, wherein the first two-wire communication circuit is configured to transmit the audio signal and the enable signal, and to receive the clip detect signal via the bus.

12. The two-wire communication system of claim 1, wherein an amplitude of the audio signal is adjustable based on the clip detect signal.

13. The two-wire communication system of claim 1, wherein the second audio circuit is activated based on the enable signal.

14. The two-wire communication system of claim 1, further comprising a third audio circuit, wherein the first, second, and third audio circuits are daisy chained via two-wire bi-directional multi-node communication buses.

15. The two-wire communication system of claim 1, wherein the first audio circuit includes a radio and the second audio circuit includes an audio amplifier circuit.

* * * * *